US009562442B2

(12) United States Patent
Yoshida et al.

(10) Patent No.: US 9,562,442 B2
(45) Date of Patent: Feb. 7, 2017

(54) TURBINE HOUSING FOR A TURBOCHARGER OF TWIN-SCROLL TYPE

(75) Inventors: Toyotaka Yoshida, Tokyo (JP); Motoki Ebisu, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 1006 days.

(21) Appl. No.: 13/696,235

(22) PCT Filed: Oct. 12, 2011

(86) PCT No.: PCT/JP2011/073410

§ 371 (c)(1),
(2), (4) Date: Jan. 28, 2013

(87) PCT Pub. No.: WO2012/060187

PCT Pub. Date: May 10, 2012

(65) Prior Publication Data

US 2013/0121820 A1 May 16, 2013

(30) Foreign Application Priority Data

Nov. 4, 2010 (JP) ..... 2010-247939

(51) Int. Cl.
*F01D 25/24* (2006.01)
*F01D 9/02* (2006.01)
*F02B 37/02* (2006.01)

(52) U.S. Cl.
CPC ..... *F01D 25/24* (2013.01); *F01D 9/026* (2013.01); *F02B 37/025* (2013.01); *F05D 2220/40* (2013.01)

(58) Field of Classification Search
CPC ..... F01D 9/026; F01D 25/24; F04D 25/04; F04D 25/045; F02C 6/12; F02B 37/00; F02B 37/025; F05D 2220/40; F05B 2220/40

(Continued)

(56) References Cited

U.S. PATENT DOCUMENTS 3,383,092 A * 5/1968 Cazier ..... F02B 37/02 415/186
4,111,598 A * 9/1978 Kasuya ..... F01D 9/026 415/202

(Continued)

FOREIGN PATENT DOCUMENTS

DE 102 58 466 A1 7/2003
JP 52-144515 A 12/1977

(Continued)

OTHER PUBLICATIONS

Chinese Notice of Allowance and English translation thereof, dated Sep. 8, 2015, for Chinese Application No. 201180032006.1.

(Continued)

*Primary Examiner* — Craig Kim
*Assistant Examiner* — Alexander White
(74) *Attorney, Agent, or Firm* — Birch, Stewart, Kolasch & Birch, LLP

(57) ABSTRACT

In a turbine housing 12 of a turbocharger 10A of a twin-scroll type, a scroll-shaped passage is separated into a front scroll passage 42 and a rear scroll passage 44 by a partition wall 40. A front wall 50 and a root part 40*b* of the partition wall 40 curve toward a front side to secure cross-sectional areas a1, a2, a3 . . . and b1, b2, b3 . . . . The scroll passages 42, 44 are formed to have equal cross-sectional areas, a tip part 40*a* of the partition wall 40 is arranged perpendicular to the turbine rotor blade 26 and the scroll passages 42, 44 are symmetrical near the tip part 40*a* about an axis X so as to eliminate the flow rate difference.

2 Claims, 4 Drawing Sheets

(58) Field of Classification Search
USPC ..... 415/71, 203, 204, 205, 212.1; 416/176, 416/177, 180, 182
See application file for complete search history.

(56) References Cited

U.S. PATENT DOCUMENTS

| | | | | |
|---|---|---|---|---|
| 5,092,126 | A * | 3/1992 | Yano | F01D 17/146 415/164 |
| 5,094,587 | A * | 3/1992 | Woollenweber | F01D 9/026 415/205 |
| 8,424,304 | B2 * | 4/2013 | Serres | F01D 17/105 60/600 |

FOREIGN PATENT DOCUMENTS

| | | | |
|---|---|---|---|
| JP | 61-250344 | A | 11/1986 |
| JP | 63-117124 | A | 5/1988 |
| JP | 63-112202 | U | 7/1988 |
| JP | 63-309724 | A | 12/1988 |
| JP | 2571056 | B2 | 10/1996 |
| JP | 2006-348894 | A | 12/2006 |

OTHER PUBLICATIONS

Chinese Office Action dated Jan. 21, 2015 issued in corresponding Chinese Application No. 201180032006.1 with an English Translation.
Chinese Office Action dated Jun. 5, 2014 issued in corresponding Chinese Application No. 201180032006.1 with an English translation.
Decision to Grant a Patent effective Nov. 5, 2014 issued in corresponding Japanese Application No. 2010-247939 with English Translation.

* cited by examiner

Related Art

Related Art

TURBINE HOUSING FOR A TURBOCHARGER OF TWIN-SCROLL TYPE

TECHNICAL FIELD

The present invention relates to a turbine housing for a turbocharger of a twin-scroll type for suppressing performance reduction of the engine by improving a flow condition of exhaust gas flowing in two scroll passages without increasing an outer diameter of the housing.

BACKGROUND ART

As a turbocharger installed in a vehicle or the like, a turbocharger of a twin-scroll type is known in which a passage between a turbine housing inlet and a leading edge of turbine rotor blades is separated into a front side (an exhaust gas outlet side) and a rear side (a bearing housing side) so as to avoid interference with the exhaust gas of a multicylinder engine and also to utilize pulsation of the exhaust gas of the engine (dynamic pressure). A twin-scroll turbocharger of this type is disclosed in Patent Literatures 1 and 2.

An example construction of the conventional turbocharger of twin-scroll type which is disclosed in Patent Literature 2 is now described in reference to FIG. 3 and FIG. 4. In FIG. 3, a turbine housing 102 of the turbocharger of the twin-scroll type has a scroll passage for the exhaust gas inside. A partition wall 104 protruding in the passage separates a scroll passage 106 on the front side and a scroll passage 108 on the rear side.

A turbine shaft 110 and a turbine wheel integrally formed with the turbine shaft 110 are arranged in a center part of the turbocharger 100. A plurality of turbine rotor blades 114 are integrally formed around the turbine wheel 112 in a radial fashion.

As shown in FIG. 4, the scroll passages 106, 108 are formed in a scroll shape. The exhaust gas e flows in the scroll passages 106, 108 from the outside toward the inside in the radial direction, and then enters the turbine rotor blades 114 from an outlet opening 116 so as to rotate the turbine wheel 112. Then, the exhaust gas e passes through an outlet casing 118 and is drained.

A bearing housing 120 is arranged next to the turbine housing 102. The turbine housing 102 is provided with a connection flange 122 in contraposition to the bearing housing 120 so that the bearing housing 120 and the turbine housing 102 are coupled to each other. The turbine housing 102 and the bearing housing 120 are fixed normally by connecting the connection flange 122 and a connection flange (not shown) provided in the bearing housing 120 by means of a coupling of a ring shape.

Near an outlet flange 124 of the turbine housing 102, a wastegate valve 126 is provided for controlling a supercharging pressure of the turbocharger 100 at a setting pressure or below. By allowing a part of the exhaust gas flowing in the front scroll passage 106 and the rear scroll passage 108 to exit the exhaust gas exit from the wastegate valve 126, the supercharging pressure of the turbocharger 100 is controlled not more than the setting value.

According to the above structure, the exhaust gas e exhausted from the engine (not shown) enters the turbine rotor blades 116 via the scroll passages 106, 108, thereby rotating the turbine wheel 110. The rotation of the turbine wheel 110 rotates a compressor wheel (not shown) coupled to the turbine shaft 110. This generates a flow of the intake air and the intake air is supplied to the combustion cylinder.

In the multicylinder engine, by dividing the exhaust gas e exhaust from the combustion cylinder to two scroll passages 106, 108 so as to suppressing the interference of the multicylinder engine with the exhaust gas energy as well as to improve the rotation efficiency of the turbine shaft 110 by using the pulsation of the exhaust gas.

In this manner, the rotation of the turbine in a low-speed rotation range is started early without decreasing A/R and thus it is possible to improve a response speed of the turbocharger in the low-speed rotation range as well as the output of the engine.

CITATION LIST

Patent Literature

[PTL 1]
JP 63-117124A
[PTL 2]
JP2006-348894 A

SUMMARY

Technical Problem

As described above, the turbine housing 102 and the bearing housing 120 are fixed to each other by connecting the flanges of the housings 102, 120 by the coupling of the ring shape. This requires a space to install the coupling. Thus, a front partition wall 128 of the turbine housing 102 inclines toward the front side (the exhaust gas outlet side). The smaller the turbocharger is to be installed in a small-size vehicle such as an automobile, the smaller the space around the coupling is. Therefore, it is necessary to design the turbine housing to fit in the small space. Further, to secure enough cross-sectional space of the scroll passage, the diameter of the scroll passage has to increase but there is a restriction on the installation space.

With the turbine housing 102 forming the scroll passage inclining toward the front side, the front scroll passage 108 inevitably inclines toward the front side as well. Therefore, as shown with an arrow in FIG. 3, flow fields on the front side and the rear side where the exhaust gas e enters are not symmetrical with respect to the line perpendicular to the leading edge 114*a* of the turbine rotor blade 114. As a result, there is a difference in flow rate between the front side passage and the rear side passage. This difference in flow rate generates difference in operation conditions on the engine side located upstream in the exhaust gas flow, which leads to performance decline of the engine.

Further, when the turbocharger of the twin-scroll type is used, the turbine housing forming the scroll passage inevitably increases in size in the radial direction to secure the cross-sectional area of the scroll passage. The issue arises that this cannot be adopted in a small layout.

In view of the above issues, it is an object of the present invention, in the turbocharger of the twin-scroll type, to secure the cross-sectional area of the scroll passage formed in the turbine housing, to keeping its outer diameter small, and to eliminate the difference in the flow rate between the front scroll passage and the rear scroll passage in the flow filed near the edge of the partition wall for separating the scroll passages from each other so as to suppress the performance decline of the engine and also to improve the supercharging performance of the turbocharger.

Solution to Problem

To achieve the above object, a turbine housing of the present invention for a turbocharger of a twin-scroll type, comprises:

a turbine shaft housed in the turbine housing;

a partition wall formed in the housing; and two scroll passages, divided by the partition wall, including a front scroll passage and a rear scroll passage formed on a front side and a rear side respectively in the turbine housing, through the scroll passages exhaust gas flowing from outside toward inside in a radial direction and then flowing in an axial direction of the turbine shaft to be discharged, wherein a front wall of the front scroll passage curves toward the front side from the inside toward the outside in the radial direction so as to secure cross-sectional areas of the front scroll passage and the rear scroll passage, wherein a root part of the partition wall curves toward the front side in correspondence with the front wall so that the cross-sectional area of the front scroll passage equals to the cross-sectional area of the rear scroll passage, and wherein the cross-sectional areas of the front scroll passage and the rear scroll passage gradually decrease from the outside toward the inside in the radial direction and a tip part of the partition wall is arranged in a direction perpendicular to a leading edge of a turbine rotor blade so that the front scroll passage and the rear scroll passage are symmetrical near the tip part with respect to an axis of the tip part.

The turbine housing of the present invention is configured so that the front wall of the front scroll passage curves toward the front side from the inside toward the outside in the radial direction. Thus it is possible to secure cross-sectional areas of the front scroll passage and the rear scroll passage while suppressing the diameter increase of the turbine housing.

Further, the root part of the partition wall curves toward the front side in correspondence with the front wall so that the cross-sectional area of the front scroll passage equals to the cross-sectional area of the rear scroll passage. Thus, the cross-sectional areas of the scroll passages taper toward the inside in the radial direction while maintaining the same cross-sectional are of the scroll passages on the outer side in the radial direction. By tapering the width of the scroll passage toward the tip part of the partition wall so that the scroll passage is narrowest at the tip part, the radial flow of the exhaust gas becomes an accelerating flow. As a result, generation of the boundary layer is suppressed, hence reducing the flow resistance.

Furthermore, the tip part of the partition wall is arranged in a direction perpendicular to the leading edge of the turbine rotor blade so that the front scroll passage and the rear scroll passage are symmetrical near the tip part with respect to the axis of the tip part. Thus, it is possible to even the flow field of the both scroll passages near the leading ledge of the turbine rotor. Therefore, the scroll passages now have the same flow conditions and it is possible to reduce differences of the flow rate and flow speed between the scroll passages hence effectively suppressing the performance decline of the engine.

Moreover, the present invention is also applicable to a turbocharger of a twin-scroll type equipped with a radial turbine, a diagonal flow turbine or the like including a variable geometry turbine.

In the turbine housing of the present invention, in addition to the above structure, the front scroll passage and the rear scroll passage have openings opening to the turbine rotor blade and the front scroll passage and the rear scroll passage are configured so that the opening of the front scroll passage has the same circular area as the opening of the rear scroll passage at the tip part of the partition wall. This makes it easier to even the flow field of both scroll passages near the leading ledge of the turbine rotor. As a result, it is possible to eliminate differences of the flow rate and flow speed between the scroll passages, hence effectively suppressing the performance decline of the engine.

In the present invention, an inner surface of the front scroll passage and an inner surface of the rear scroll passage incline toward a center of the turbine rotor blade in a direction of a flow of the exhaust gas near an outlet of the scroll passages so that the exhaust gas flowing in the front scroll passage and the exhaust gas flowing in the rear scroll passage flows toward the center obliquely.

As a result, the flow of the exhaust gas flows toward the center of the leading edge of the turbine rotor. Thus, it is possible to prevent the exhaust gas from flowing toward the inner surface on the front side or the inner surface on the rear side. Therefore, the exhaust gas flows in the turbine rotor blade evenly even under pulsation of the exhaust gas flow caused by the operation condition of the engine. By this, the supercharging performance decline of the turbocharger is effectively prevented.

In the present invention, a diffusion space is formed between the tip part of the partition wall and the leading edge of the turbine rotor so that the exhaust gas exiting the front scroll passage and the rear scroll passage diffuse throughout outlet openings of the front and rear scroll passages. In the multicylinder engine, the exhaust gas is exhausted from each combustion cylinder at different timing, hence entering the turbine rotor blade from the both scroll passages at different timings. By diffusing the exhaust gas throughout the outlet openings of the front and rear scroll passages, it is possible to always form the even flow field. As a result, the drift is suppressed and the performance decline of the turbocharger is prevented effectively.

In the present invention, a rear wall of the rear scroll passage of the turbine housing is arranged perpendicular to an axis of the turbine shaft. Thus, the rear wall does not get in the way of installing the coupling for fixing the turbine housing and the bearing housing together. This makes it easier to arrange the rear scroll passage perpendicular to the leading edge of the turbine rotor blade. As a result, it is easier to form, near the tip part of the partition wall, the exhaust gas flow that is symmetrical about the axis of the partition wall.

Advantageous Effects

According to the present invention, a turbine housing for a turbocharger of a twin-scroll type, comprises: a turbine shaft housed in the turbine housing; a partition wall formed in the housing; and two scroll passages, divided by the partition wall, including a front scroll passage and a rear scroll passage formed on a front side and a rear side respectively in the turbine housing, through the scroll passages exhaust gas flowing from outside toward inside in a radial direction and then flowing in an axial direction of the turbine shaft to be discharged, wherein a front wall of the front scroll passage curves toward the front side from the inside toward the outside in the radial direction so as to secure cross-sectional areas of the front scroll passage and the rear scroll passage, wherein a root part of the partition wall curves toward the front side in correspondence with the front wall so that the cross-sectional area of the front scroll passage equals to the cross-sectional area of the rear scroll passage, and wherein the cross-sectional areas of the front scroll passage and the rear scroll passage gradually decrease from the outside toward the inside in the radial direction and a tip part of the partition wall is arranged in a direction perpendicular to a leading edge of a turbine rotor blade so that the front scroll passage and the rear scroll passage are symmetrical near the tip part with respect to an axis of the tip part. Thus it is possible to secure cross-sectional areas of the scroll passages while suppressing the diameter increase of the turbine housing and also to eliminate differences of the flow rate and flow speed between the scroll passages, hence effectively suppressing the performance decline of the engine.

DETAILED DESCRIPTION

Embodiments of the present invention will now be described in detail with reference to the accompanying drawings. It is intended, however, that unless particularly specified in these embodiments, dimensions, materials, shape, its relative positions and the like shall be interpreted as illustrative only and not limitative of the scope of the present invention.

First Embodiment

Figure 1:
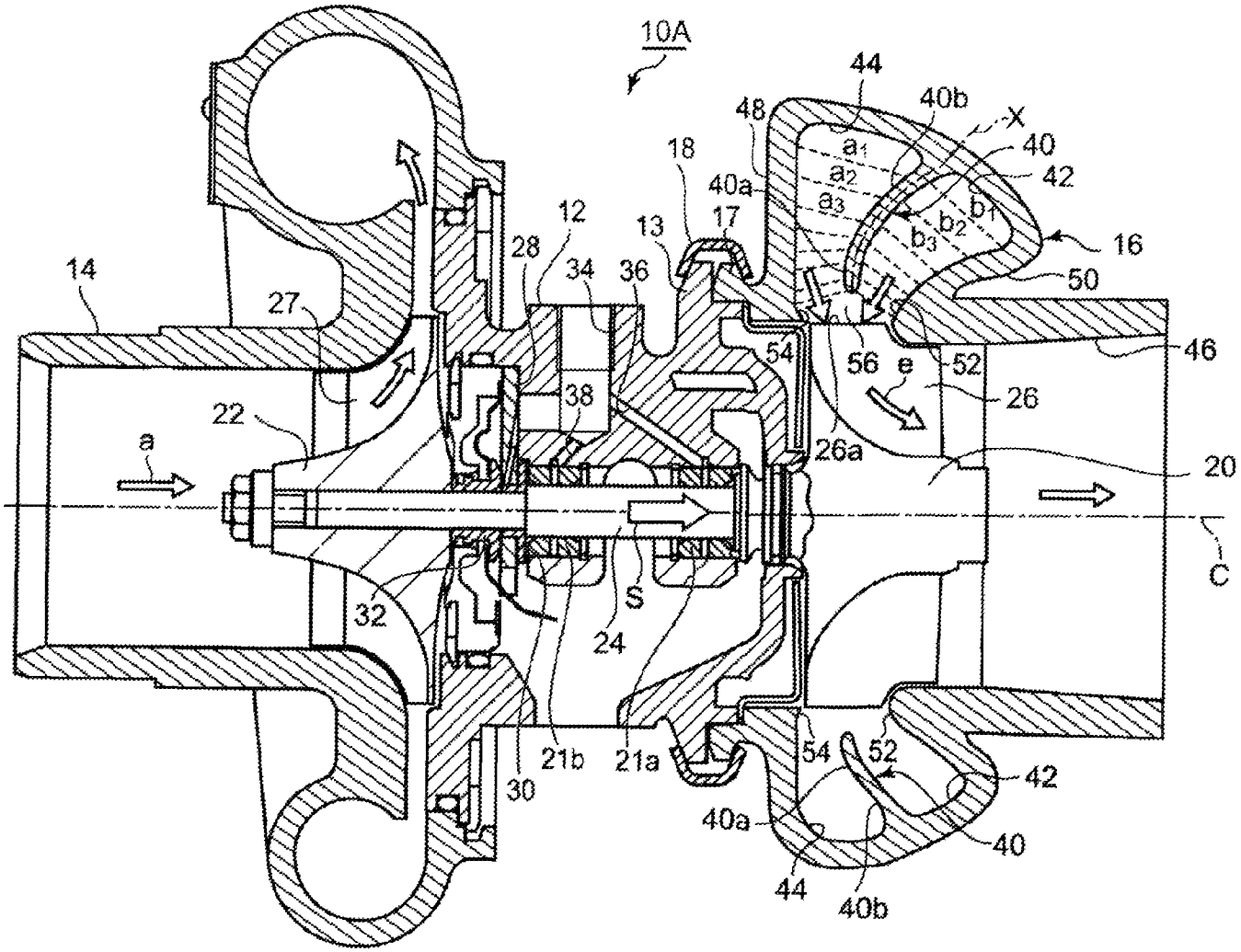
FIG. 1 is a sectional front view of a turbine housing regarding a first embodiment.

Described in reference to FIG. 1 is a first embodiment in which a turbine housing of the present invention is applied to a small turbocharger of a twin-scroll type which is installed in a compact vehicle such as a passenger vehicle equipped with a multicylinder engine. The housing of the turbocharger 10A of the twin-scroll type shown in FIG. 1 is configured such that a compressor housing 14 and a turbine housing 16 are arranged on both sides of a bearing housing 12 and are coupled to the bearing housing 12. The bearing housing 12 and the turbine housing 16 are coupled at their ends by fastening and fixing connection flanges 13, 17 of the housings 12, 16 by means of a coupling 18 of a ring shape.

Inside the housing of the turbocharger 10A, a turbine wheel 20 and a compressor wheel 22 are coupled via a turbine shaft 24 integrally formed with the turbine wheel 20. A plurality of turbine rotor blades 26 are formed integrally around the turbine wheel 20 in a radial fashion. A plurality of compressor rotor blades 27 are formed around the compressor wheel 22 in a radial fashion. The turbine shaft 24 is supported rotatably by a pair of floating bearings 21*a*, 21*b* inside the bearing housing 12.

In the turbocharger 10A, a thrust force acting on the turbine wheel 20 in a direction of a center axis C and a thrust load S being a difference between the thrust force on the turbine wheel 20 and a thrust force on the compressor wheel 22 are applied to the turbine shaft 24 leftward in the drawing (toward the turbine wheel 20). The thrust bearing 28 is held between a turbine-wheel-side thrust collar 30 and a compressor-side thrust collar 32 that are fixed to the turbine shaft 24 at their inner peripheries. The thrust bearing 28 slidingly contacts the bearing housing 12 to support the thrust load S while rotating with the turbine shaft 24.

Oil supply passages 34, 36 are formed through the bearing housing 12. Via the oil supply passages 34, 36, the lubricating oil is supplied to the floating bearing 21*a*, 21*b*.

In the turbine housing 16, a scroll-shaped passage formed between a turbine housing inlet and a leading ledge of the turbine rotor blade is separated into a front scroll passage 42 (an exhaust exit side) and a rear scroll passage 44 (a bearing housing 12 side) by a partition wall 40 projecting in a middle section of the passage.

As shown in FIG. 1, the exhaust gas e exhausted from the engine (not shown) flows through the scroll passages 42, 44 and enters the turbine rotor blade 26 to rotate the turbine wheel 20. Upon rotation of the turbine wheel 20, the compressor wheel 22 and the compressor rotor blade 27 rotate. This generates an intake air flow a and the intake air is supplied to a combustion cylinder of the engine. In the multicylinder engine, the flow of the exhaust gas e exhausted from the combustion cylinder (not shown) is separated into the scroll passages 42, 44. As a result, interference with the exhaust gas of a multicylinder engine is reduced and pulsation of the exhaust gas of the engine is utilized, hence improving rotation efficiency of the turbine shaft 34.

In this manner, the rotation of the turbine in a low-speed rotation range is started early without decreasing A/R and thus a response speed of the turbocharger is improved in the low-speed rotation range as well as the output of the engine.

The exhaust gas e exhausted from the multicylinder engine side (not shown) flows through both of the scroll passages at different timings and reaches an outlet opening 56 of the scroll passage. The exhaust gas e having reached the outlet opening 56 hits the turbine rotor blade 26 to rotate the turbine wheel 20, and then is discharged through an outlet casing 46.

Outside a rear wall 48 of the turbine housing 16, a space is secured for installing the coupling. In this embodiment, the rear wall 48 projects perpendicular to the center axis C and a front wall 50 of the turbine housing 16 curves toward the front side to secure cross-sectional areas a1, a2, a3 . . . of the front scroll passage 42 and cross-sectional areas b1, b2, b3 . . . of the rear scroll passage 44. As a result, the cross-sectional area of each of the scroll passages 42, 44 is enlarged on the outer side in the radial direction. Thus, the cross-sectional area tapers toward the inner side in the radial direction so that the cross-sectional area becomes the smallest near a tip part of the partition wall 40.

The partition wall 40 is shaped such that a root part 40*b* of the partition wall 40 on the outer side in the radial direction curves toward the front side in correspondence with the shape of the front wall 50. Thus the cross-sectional area of the front scroll passage 42 on the outer side in the radial direction equals to that of the rear scroll passage 44. The tip part 40*a* of the partition wall 40 is disposed at such a position that the outlet opening 56 of the front scroll passage 42 has the same circular area as the outlet opening 56 of the rear scroll passage 44 at the tip part 40*a* of the partition wall 40. The tip part 40*a* is positioned in a direction substantially perpendicular to the leading edge 26*a* of the turbine rotor 26.

Near the outlet opening 56 of the scroll passages 42, 44, an inner surface 52 of the front scroll passage 42 and an inner surface 54 of the rear scroll passage 44 incline toward a center of the turbine rotor blade in a direction of the flow of the exhaust gas. As a result, the flow of the exhaust gas flowing in the scroll passages 42, 44 become an inclined flow flowing toward the center of the turbine rotor blade 26. Thus, near the tip part 40*a* of the partition wall 40, the scroll passages 42, 44 are symmetrical with respect to an axis X of the partition wall 40.

In the case of the multicylinder engine, the exhaust gas e flows into the scroll passages 42, 44 from different combustion cylinders. Moreover, the exhaust gas e flows into the scroll passages 42, 44 at different timings and alternately from different combustion cylinders with pulsation.

According to this embodiment, the front wall 50 of the turbine housing 16 curves toward the front side. Thus the cross-sectional areas of the scroll passages 42, 44 on the outer side in the radial direction, a1, a2, a3 . . . and b1, b2, b3 . . . are increased without increasing the diameter of the turbine housing 12.

Further, the cross-sectional areas of the scroll passages 42, 44 taper toward the inner side in the radial direction so that the cross-sectional area becomes the smallest near a tip part of the partition wall 40. Thus, the exhaust gas e becomes an accelerating flow. As a result, generation of the boundary layer is suppressed on the surface of the wall forming the scroll passage, hence reducing a pressure loss of the exhaust gas e.

The front scroll passage 42 and the rear scroll passage 44 are configured to have the same cross-sectional from the outer side to the inner side in the radial direction and also to have the same circular area of the opening which opens to the turbine rotor blade 26 at the tip part 40*a* of the partition wall 40. This makes it easier to even a flow field of the both scroll passages near the leading ledge of the turbine rotor 26. As a result, it is possible to eliminate differences of the flow rate and flow speed between the scroll passages 42, 44, hence effectively suppressing the performance decline of the engine.

Further, the tip part 40*a* of the partition wall 40 is arranged in the direction perpendicular to the leading edge 26*a* of the turbine rotor blade 26 and the front scroll passage 42 and the rear scroll passage 44 are symmetrical near the tip part with respect to the axis X of the tip part 40*a*. Thus, the flow field of the both scroll passages is evened near the turbine rotor 26. As a result, it is possible to eliminate differences of the flow rate and flow speed between the scroll passages 42, 44 even when the exhaust gas e enters the scroll passages 42, 44 with pulsation. This causes no difference in the operating conditions on the engine side located upstream from the exhaust gas passage. Thus, the engine performance is maintained.

Furthermore, near the outlet opening 56 of the scroll passages 42, 44, the inner surface 52 of the front scroll passage 42 and the inner surface 54 of the rear scroll passage 44 incline toward the center of the turbine rotor blade 26 in the direction of the flow of the exhaust gas.

Moreover, the rear wall 48 is arranged perpendicular to the axis X and thus the rear wall 48 does not get in the way of installing the coupling 18. This makes it easier to arrange the rear scroll passage 44 perpendicular to the leading edge 26*a* of the turbine rotor blade 26. As a result, it is easier to form, near the tip part 40*a* of the partition wall 40, the exhaust gas flow that is symmetrical about the axis X of the partition wall 40.

Second Embodiment

Figure 2A:
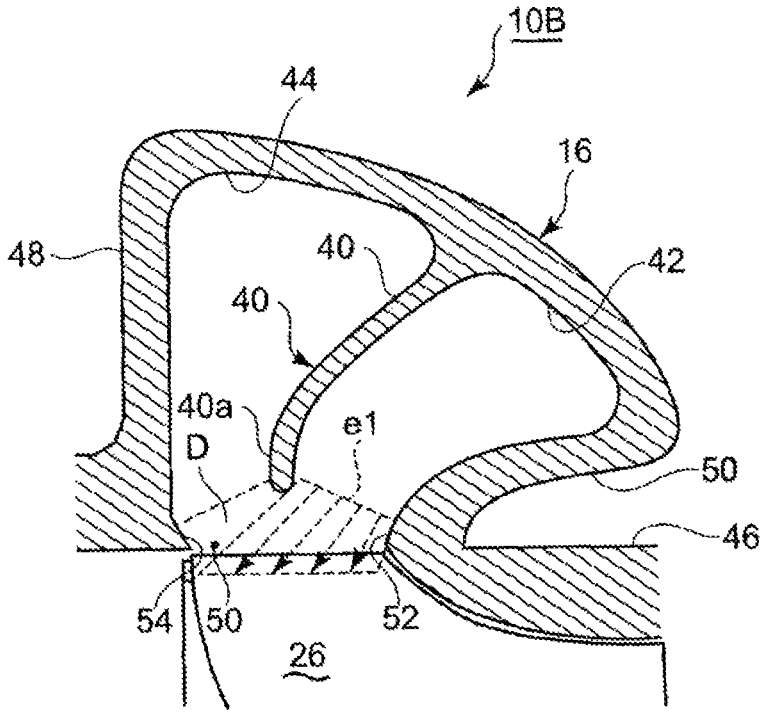
FIG. 2A is a sectional front view of the turbine housing regarding a second embodiment.
Figure 2B:
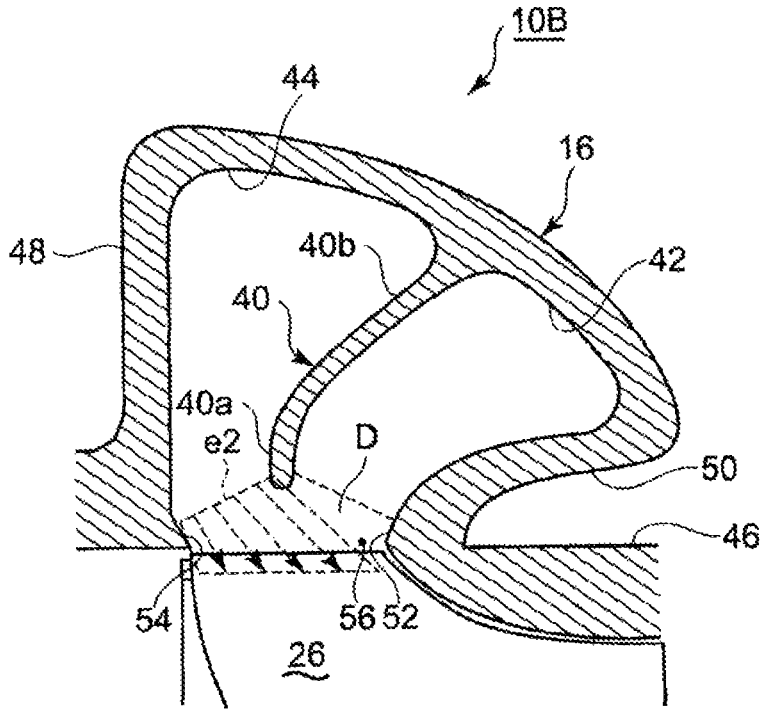
FIG. 2B is a sectional front view of the turbine housing regarding the second embodiment.
Figure 3:
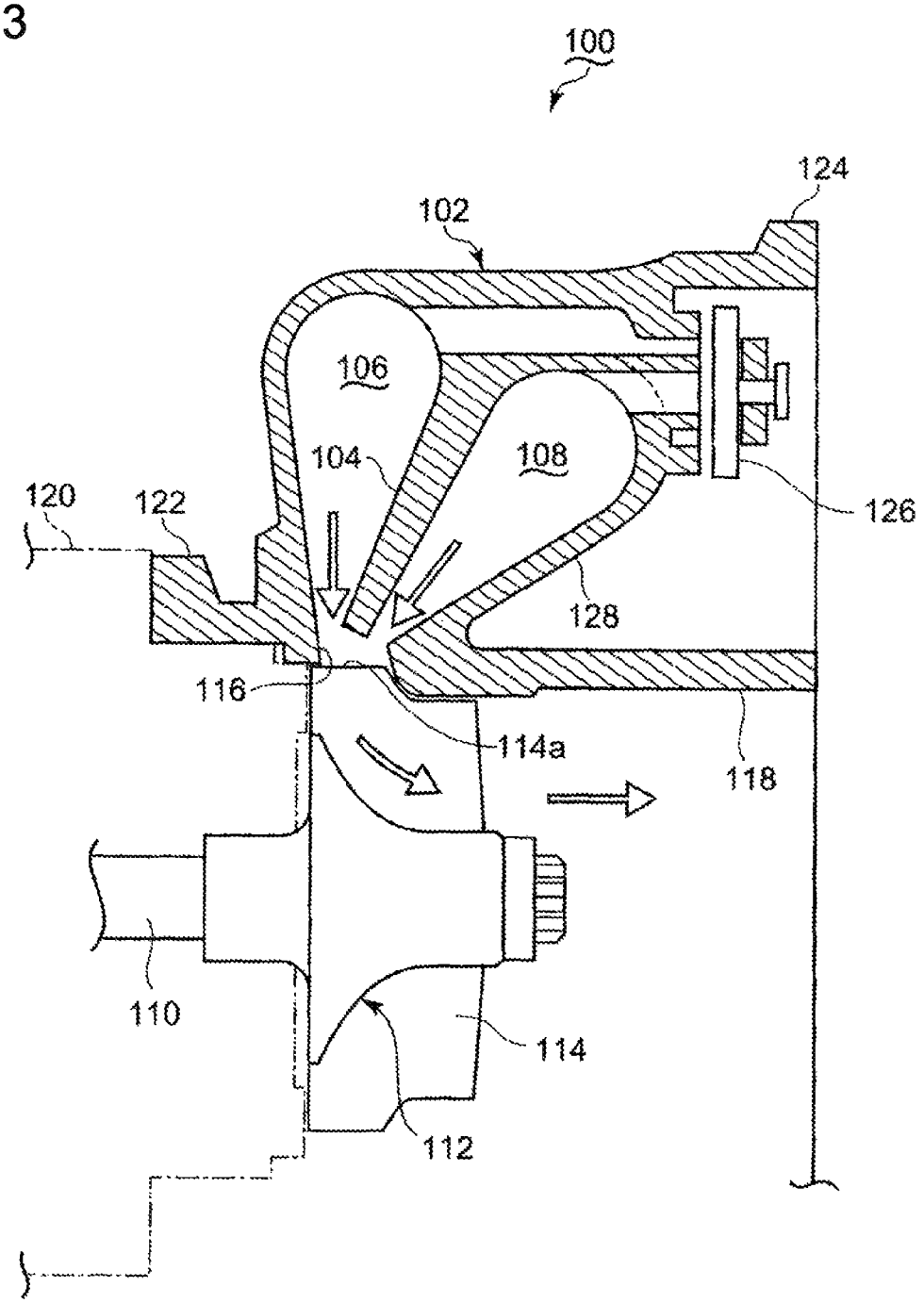
FIG. 3 is a sectional front view of a turbocharger of a twin-scroll type regarding related art.
Figure 4:
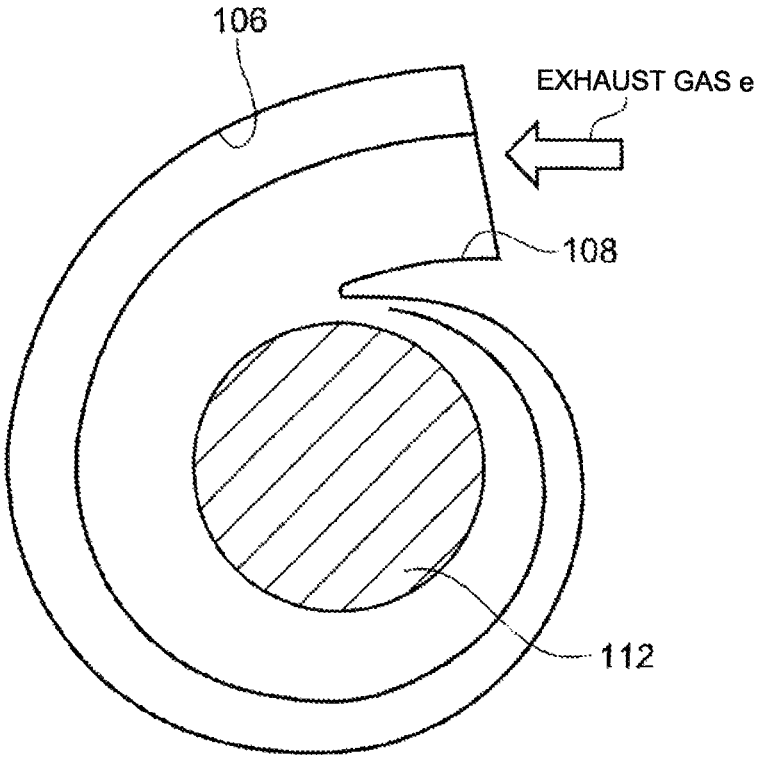
FIG. 4 is an illustration of a scroll passage of the turbocharger of FIG. 3.

Described in reference to FIG. 2A and FIG. 2B is a second embodiment in which a turbine housing of the present invention is applied to a small turbocharger of a twin-scroll type which is installed in a compact vehicle such as a passenger vehicle equipped with a multicylinder engine in the same manner as the first embodiment. In a turbocharger of a twin-scroll type shown in FIG. 2A and FIG. 2B, the tip part 40*a* of the partition wall 40 of the turbine housing 16 is arranged farther from the turbine rotor blade 26 that that of the first embodiment, so as to form a diffusion space D. The rest of the configuration is substantially the same as the turbocharger 10A of the first embodiment.

As described above, the exhaust gas e enters the scroll passages 42, 44 at different timings. In this embodiment, in a manner similar to the first embodiment, near the outlet opening 56 of the scroll passages 42, 44, the inner surface 52 of the front scroll passage 42 and the inner surface 54 of the rear scroll passage 44 incline toward the center of leading edge 26*a* of the turbine rotor blade 26 in the direction of the flow of the exhaust gas. As a result, the flow of the exhaust gas flowing in the scroll passages 42, 44 become an inclined flow flowing toward the center of the turbine rotor blade 26.

In this embodiment, the diffusion space is formed between the tip part 40*a* of the partition wall 40 and the leading edge 26*a* of the turbine rotor blade 26. Thus, the flows e1, e2 of the exhaust gas entering the turbine rotor blade 26 from the scroll passages 42, 44 diffuse throughout the outlet opening 56 as shown in the drawings. Therefore, the flow field near the tip part 40*a* becomes even compared to the first embodiment. The drift toward the inner surface 52 on the front side and the inner surface 54 on the rear side is suppressed, hence further suppressing the performance decline of the turbocharger.

INDUSTRIAL APPLICABILITY

According to the present invention, even in the case of the scroll passage having comparatively large cross-sectional area, it is possible to reduce the outer diameter and to even the flow field where the exhaust gas enters the turbine rotor blade. As a result, the turbocharger of the twin-scroll type which does not cause the performance decline of the engine arranged upstream can be obtained.

The invention claimed is:

1. A turbine housing for a turbocharger of a twin-scroll type, comprising: a turbine shaft housed in the turbine housing;

a partition wall formed in the turbine housing; and two scroll passages divided by the partition wall and including a front scroll passage and a rear scroll passage formed on a front side and a rear side respectively in the turbine housing, wherein through the two scroll passages exhaust gas flows from an outside toward an inside in a radial direction and then flows in an axial direction of the turbine shaft to be discharged, wherein a rear wall of the rear scroll passage of the turbine housing is arranged perpendicular to an axis of the turbine shaft so as to form an inner surface of the rear scroll passage perpendicular to the axis of the turbine shaft, wherein a front wall of the front scroll passage curves toward the front side from the inside toward the outside in the radial direction so as to secure cross-sectional areas of the front scroll passage and the rear scroll passage, wherein a root part of the partition wall curves toward the front side in correspondence with the front wall so that the cross-sectional area of the front scroll passage equals to the cross-sectional area of the rear scroll passage, and wherein the cross-sectional areas of the front scroll passage and the rear scroll passage gradually decrease from the outside toward the inside in the radial direction and a tip part of the partition wall is arranged in a direction perpendicular to a leading edge of a turbine rotor blade so that the front scroll passage and the rear scroll passage are symmetrical near the tip part with respect to an axis of the tip part, wherein a diffusion space is formed between the tip part of the partition wall and the leading edge of the turbine rotor, wherein a vertical inner surface of the rear scroll passage perpendicular to the axis of the turbine shaft extends to a position beyond the tip part of the partition wall into said diffusion space;

in the diffusion space an inner surface of the front scroll passage inclines toward a center of the turbine rotor blade; and in the diffusion space the vertical inner surface of the rear scroll passage deviates at said position beyond the tip part of the partition wall to incline toward a center of the turbine rotor blade in a direction of a flow of the exhaust gas so that the exhaust gas flowing in the front scroll passage and the exhaust gas flowing in the rear scroll passage flow symmetrically toward the center obliquely.

2. The turbine housing for the turbocharger of the twin-scroll type, according to claim 1, wherein the front scroll passage and the rear scroll passage have openings opening to the turbine rotor blade and the front scroll passage and the rear scroll passage are configured so that the opening of the front scroll passage has the same circular area as the opening of the rear scroll passage at the tip part of the partition wall.

* * * * *